US010532854B2

(12) United States Patent
Jain

(10) Patent No.: US 10,532,854 B2
(45) Date of Patent: Jan. 14, 2020

(54) DRUM STACKING ASSEMBLY

(71) Applicant: Genex Science and Technologies Pvt. Ltd., Andheri (East), Mumbai (IN)

(72) Inventor: Anil Jain, Mumbai (IN)

(73) Assignee: Genex Science and Technologies Pvt. Ltd., Mumbai (IN)

( * ) Notice: Subject to any disclaimer, the term of this patent is extended or adjusted under 35 U.S.C. 154(b) by 100 days.

(21) Appl. No.: 15/724,266

(22) Filed: Oct. 3, 2017

(65) Prior Publication Data

US 2018/0290789 A1 Oct. 11, 2018

(30) Foreign Application Priority Data

Apr. 8, 2017 (IN) ..... 201721012698

(51) Int. Cl.
*B65D 21/02* (2006.01)
*B65D 71/70* (2006.01)
(Continued)

(52) U.S. Cl.
CPC ..... *B65D 21/0224* (2013.01); *B65D 19/004* (2013.01); *B65D 19/44* (2013.01); *B65D 71/70* (2013.01); *B65D 25/20* (2013.01); *B65D 71/502* (2013.01); *B65D 2501/24649* (2013.01); *B65D 2519/00024* (2013.01); *B65D 2519/00034* (2013.01); *B65D 2519/00059* (2013.01); *B65D 2519/00069* (2013.01); *B65D 2519/00129* (2013.01); *B65D 2519/00268* (2013.01); *B65D 2519/00288* (2013.01); *B65D 2519/00318* (2013.01); *B65D 2519/00338* (2013.01);
(Continued)

(58) Field of Classification Search
CPC .... B65D 21/0224; B65D 21/00; B65D 71/70; B65D 2501/24649; B65D 2519/00034; B65D 19/004; B65D 19/44; B65D 2519/00815; B65D 2519/00437; B65D 2519/00129; B65D 21/02; B65D 85/20; B65D 71/00; B65D 71/0088; B65D 71/00043; B65D 71/00061
USPC ..... 206/446, 386, 599, 501, 564
See application file for complete search history.

(56) References Cited

U.S. PATENT DOCUMENTS 2,702,641 A * 2/1955 Arthur ..... B66C 1/625 211/85.18
3,143,210 A * 8/1964 Heydon ..... B65D 67/02 206/159
(Continued)

FOREIGN PATENT DOCUMENTS

EP 2374722 A1 10/2011

*Primary Examiner* — Rafael A Ortiz

(57) ABSTRACT

Disclosed is a drum stacking assembly 100. The assembly 100 comprises a first set of plurality of drums 108*a* and a second set of plurality of drums 108*b*, positioned relative amongst each other via a first connector 101 and a second connector respectively. Further, said assembly 100 comprises a pallet 109, wherein a top surface of the pallet 109 comprises a plurality of support shells 601 further comprising at least a plurality of ribs 602 adapted to support the first set of drums 108*a*. An outer reinforcing ring of the bottom surface of the first set of drums 108*a* is guided in the plurality of ribs 602. Further, a bottom surface of the pallet 109 comprises a plurality of grooves 202 further comprising at least a plurality of indentations 603 adapted to engage an outer reinforcing ring 301 of the upper surface of the second set of drums 108*b*.

9 Claims, 18 Drawing Sheets

(51) Int. Cl.

| | |
|---|---|
| ***B65D 19/00*** | (2006.01) |
| ***B65D 19/44*** | (2006.01) |
| *B65D 25/20* | (2006.01) |
| *B65D 71/50* | (2006.01) |

(52) U.S. Cl.
CPC ..... *B65D 2519/00348* (2013.01); *B65D 2519/00437* (2013.01); *B65D 2519/00815* (2013.01); *B65D 2519/00965* (2013.01)

(56) References Cited

U.S. PATENT DOCUMENTS

| | | | | |
|---|---|---|---|---|
| 4,729,505 | A | 3/1988 | Remaks et al. | |
| 4,838,419 | A * | 6/1989 | Weits | B65D 71/70 206/386 |
| 5,226,558 | A | 7/1993 | Whitney et al. | |
| 5,429,236 | A * | 7/1995 | Evans | B65D 19/0016 108/55.1 |
| 6,349,656 | B1 * | 2/2002 | Mitchell | B65D 19/0087 108/53.1 |
| 7,497,332 | B1 * | 3/2009 | Schwimmer | B65D 5/4287 206/600 |
| 8,025,208 | B2 | 9/2011 | Wisecarver et al. | |
| 2011/0180556 | A1 | 7/2011 | Packgen | |
| 2013/0206043 | A1 * | 8/2013 | Baltz | B65D 19/0004 108/57.13 |

* cited by examiner

DRUM STACKING ASSEMBLY

CROSS-REFERENCE TO RELATED APPLICATIONS AND PRIORITY

The present application does claim priority from the Indian patent application number 201721012698 filed on 8 Apr. 2017.

TECHNICAL FIELD

The present subject matter described herein, in general, relates to a field of industrial packaging products. In particular, the present subject matter is related to a plurality of drum stacking assembly.

BACKGROUND

Industrial packaging products include drums, containers, boxes, paper packaging, and the like. These industrial products have to be transported from one location to other for supplying the material contained therein. In general, multiple such products are stacked while being carried from source location to destination location. In the past, various accidents cases have been reported while these products were being stacked or de-stacked and put into or taken out of storage while many of these accidents are serious, some are fatal. While these hazards are always present, proper work practices such as minimizing handling and using equipments and procedures that isolate workers from hazardous substances can minimize the risks to site personnel. There are various storage systems and stacking methods in use today.

The industrial packaging products can be used for transporting chemical substances which are toxic, hazardous, viscous, expensive and explosive. Thus, prior to any handling, drums should be visually inspected to gain as much information as possible about their contents. In case of drums filled with such chemical products, it is very essential to cling all the drums with proper fixatures while stacking and transportation. There is a possibility that during transportation the vehicle carrying such drums filled with such chemical products, may suffer vibrations during transportation. This may result in collapsing of such filled drums. In worst cases, such vehicles may also experience accident during transportation. In such situations, the chemical products may leak in a huge quantity and may be hazardous for the surroundings and human beings.

Many a times the drums may comprise fluids that may evaporate when they come in contact with the outdoor atmosphere. In case of such fluid comprised in the drums while transportation, it is very essential that the drums are fixed and assembled with the help of proper stacking. Drawbacks in stacking such drums during transportation may cause the drums to collapse due to relative lateral movement of one or more drums and endanger the vicinity. The pallets, the connectors connecting the plurality of drums must be stacked in such a way that intense vibrations may not allow the drums to move from the stacking assembly.

Therefore, there is long standing need of a plurality of drum stacking assembly enabling proper fixature of plurality of drums while stacking and transporting.

SUMMARY

This summary is provided to introduce concepts related to a drum stacking assembly. This summary is not intended to identify essential features of the claimed subject matter nor is it intended for use in determining or limiting the scope of the claimed subject matter.

In one implementation, a drum stacking assembly is described. The drum stacking assembly may comprise a first set of plurality of drums positioned relative amongst each other via a first connector and a second set of plurality of drums positioned relative amongst each other via a second connector. Further, the drum stacking assembly may comprise a pallet, wherein a top surface of the pallet comprises a plurality of support shells. The plurality of support shells comprises at least a plurality of ribs upwardly projected and adapted to support the first set of drums. An outer reinforcing ring of the bottom surface of the first set of drums is guided in the plurality of ribs in order to engage the first set of drums with the pallet. Further, a bottom surface of the pallet may comprise a plurality of grooves. The plurality of grooves comprises at least a plurality of indentations downwardly projected and adapted to engage an outer reinforcing ring of the upper surface of the second set of drums thereby locking the second set of drums with the pallet.

BRIEF DESCRIPTION OF THE DRAWINGS

The detailed description is described with reference to the accompanying figures. In the figures, the left-most digit(s) of a reference number identifies the figure in which the reference number first appears. The same numbers are used throughout the drawings to refer like features and components.

DETAILED DESCRIPTION

Reference throughout the specification to "various embodiments," "some embodiments," "one embodiment," or "an embodiment" means that a particular feature, structure, or characteristic described in connection with the embodiment is included in at least one embodiment. Thus, appearances of the phrases "in various embodiments," "in some embodiments," "in one embodiment," or "in an embodiment" in places throughout the specification are not necessarily all referring to the same embodiment. Furthermore, the particular features, structures or characteristics may be combined in any suitable manner in one or more embodiments.

Figure 1:
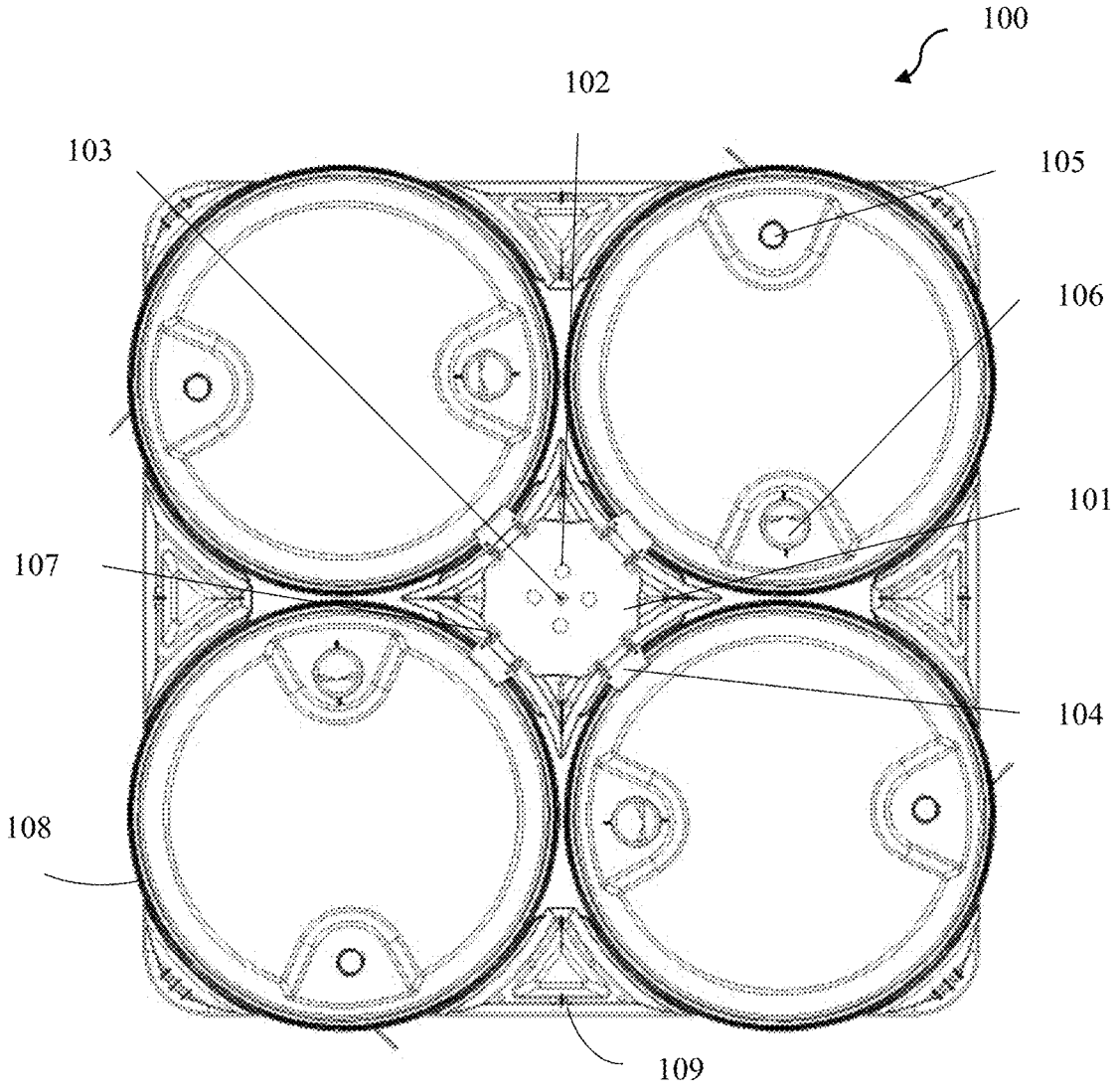
FIG. 1 illustrates a top view of a drum stacking assembly 100, in accordance with an embodiment of the present subject matter.
Figure 2:
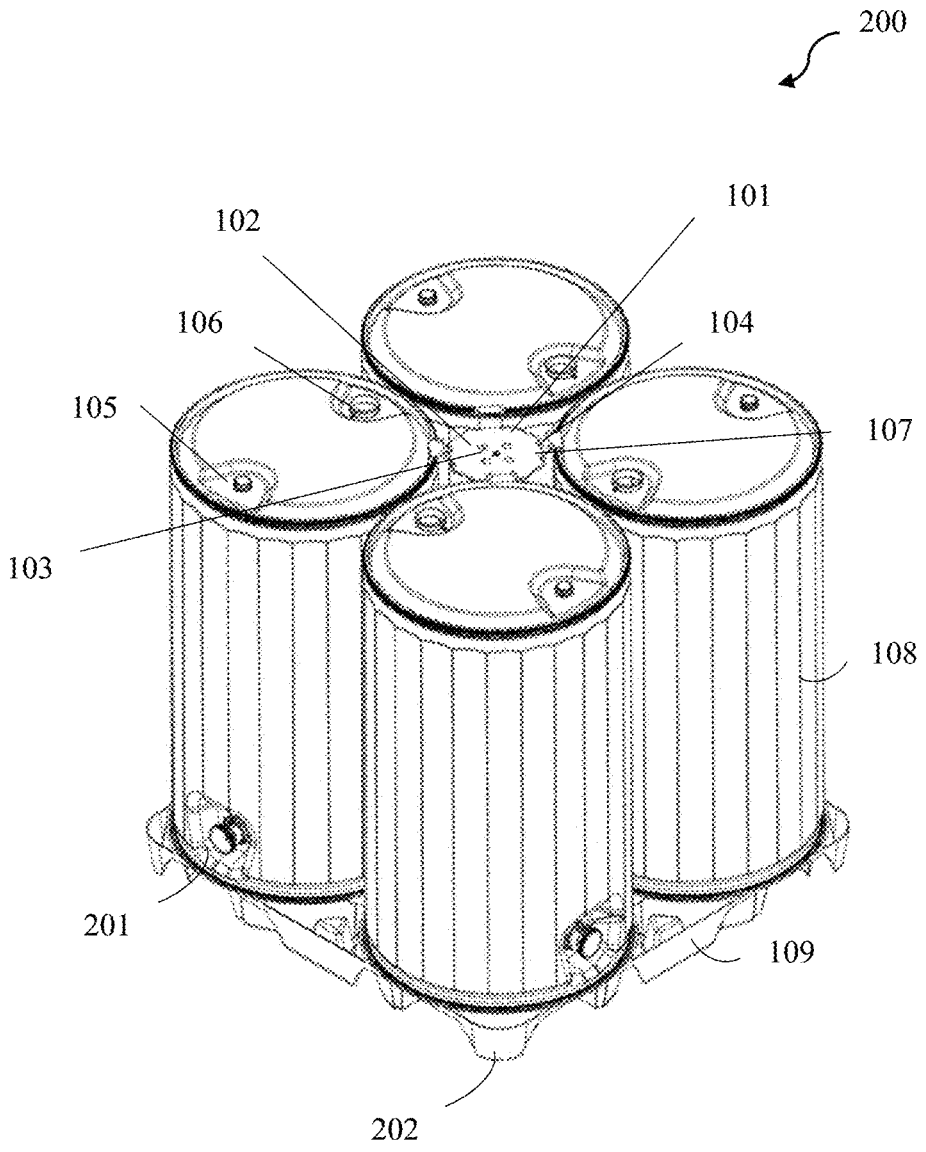
FIG. 2 illustrates a perspective view 200 of the drum stacking assembly 100, in accordance with an embodiment of the present subject matter.

Referring now to FIGS. 1 and 2, a top view and a perspective view 200 of a drum stacking assembly 100 are illustrated in accordance with the present subject matter. In one embodiment, the drum stacking assembly 100 may comprise a plurality of drums 108, a pallet 109, and a connector 101. In one embodiment, the connector 101 may further comprise a plurality of clamping means 104 at multiple edges 104 of the connector 101, a screw-rod fitting 103, a plurality of surface corrugations, a plurality of cut-outs 102 on the surface of the connector 101. The connector 101 may be connected to the clamping means 104 via a plurality of coupling means 107. Each of the plurality of drums 108 may optionally comprise a discharge valve 201. In one embodiment, each drum of the plurality of drums 108 may further comprise an inlet 106 and an opening 105.

In one embodiment, each of the plurality of drums 108 may be placed in the pallet 109. The pallet 109 may be grooved in accordance with the dimensions of the drums 108. In one embodiment, each of the drums 108 may be polygonal in shape. Further, the inlet 106 on the upper surface of each of the drums 108 may enable filling of the drums 108 with required fluid. Further, the opening 105 on the upper surface of each of the drums 108 may be enabled for discharging of the fluid from the drums 108 through an external suction means. In one embodiment, the discharge valve 201 optionally provided in each of drums 108 is configured to act as an outlet. The discharge valve 201 may be useful to discharge the fluid in the drums 108. Many a times hazardous and non-touchable material may be filled in the drums 108 for transportation, hence in order to safely take out such material or fluids from the drums 108, the discharge valve 201 may be used. The discharge valve 201 may comprise an operating handle that may enable to stop or start the flow of the material or fluid inside the drums 108. The drums 108 may be manufactured via blow molding or rotational molding technique In one embodiment, the plurality of drums 108 may be relatively connected with each other via the connector 101. The connector 101 may be configured to enable connection amongst the plurality of drums 108 thereby providing a fixed constraint for placement of the plurality of drums 108 on the pallet 109. In one embodiment, the connector 101 may further comprise the screw-rod fitting 103, wherein the screw-rod fitting 103 may be configured to lock the connector 101 with the pallet 109. The connector 101 may further comprise the plurality of surface corrugations (not shown in figure) configured for providing strength to the surface of the connector 101. The connector 101 may furthermore comprise a plurality of cut-outs 102 on the surface of the connector 101. The plurality of cut-outs 102 may enable reducing the stress concentration at the cut-outs 102 and thereby increase the load bearing capacity of the connector 101. Further, the plurality of cut-outs 102 may enable reducing weight of the connector 101. Further, the plurality of cut-outs 102 may allow seepage of water or any liquid content accumulated on the connector 101. Furthermore, the plurality of cut-outs 102 may enable a provision to check whether the screw-rod (not shown in figure) of the screw-rod fitting 103 is fixed at an appropriate location within the pallet 109.

In one embodiment, the drums, containers etc. while stacking, packaging or transporting may be placed in a fixed constraint in a pallet. The said fixature may be obtained by a connector 101, wherein the connector 101 may relatively connect the plurality of drums 108. In one embodiment, said connector 101 may be polygonal in shape and may be made of material including, but not limited to, metal, polymer or any like material. The connector 101 may be placed in between the drums 108, wherein the drums 108 may be relatively placed amongst each other. The connector 101 may comprise a plurality of U-shaped clamping means 104 connected at multiple edges of the connector 101. The clamping means 104 may be connected to the connector 101 via a plurality of coupling means 107 for enabling clamping of the connector 101 with the plurality of drums 108, wherein the plurality of drums 108 may be placed relatively with each other and connector 101. A first portion of each of the clamping means 104 may be coupled with one of the coupling elements 107. Further, a second portion perpendicular to the first portion may be adapted to clamp an outer reinforcing ring of the drum from both inside and outside of the said outer reinforcing ring provided on an upper surface of a drum of the plurality of drums 108 such that the connector 101 may be surrounded by plurality of drums 108. The connector 101 may be placed at a predetermined distance from top of the plurality of drums 108. The connector 101 may be configured to thereby providing a fixed constraint to the plurality of drums 108 placed on the pallet 109. The clamping means 104 may be connected with the connector 101 via the plurality of coupling elements 107. In one embodiment, the coupling elements 107 may be made of metals or like materials. In one embodiment, the coupling elements 107 may be chains or links. The said clamping may provide a fixed constraint to the plurality of drums 108 placed on the pallet 109. The said coupling elements 107 may prevent off-positioning of the drums 108 during stacking. In one embodiment, the connector assembly may further comprise a screw-rod fitting 103, wherein the screw-rod fitting 103 may further comprise a screw rod (not shown in figure) extending from the center of the connector 101 and fastened at the center of the pallet 109. The said screw-rod fitting 103 may be adapted to lock the connector 101 with the pallet 109. The screw rod may act as a connecting rod between the connector 101 and the pallet 109. In one embodiment, the fastening of the screw-rod 103 on the pallet 109 may be enabled by a metal insert.

In one embodiment, the pallet 109 may comprise a predefined support shells for confined placing of the plurality of drums 108, wherein the said predefined support shells may be molded in accordance with the dimensions of the plurality of drums 108. In one embodiment, the drum stacking assembly 100 may enable the stacking of plurality of drums 108 by engaging a predefined portion of the pallet 109 on the outer reinforcing ring of the multiple drums 108 below the successive pallet 109 with the help of plurality of grooves 202. The said predefined portion may not be limited to said measurements. The pallet 109 may be made of polymer material but may not be limited to said material. The pallet 109 may be molded in a continual manner, without breaks or patches.

Figure 5:
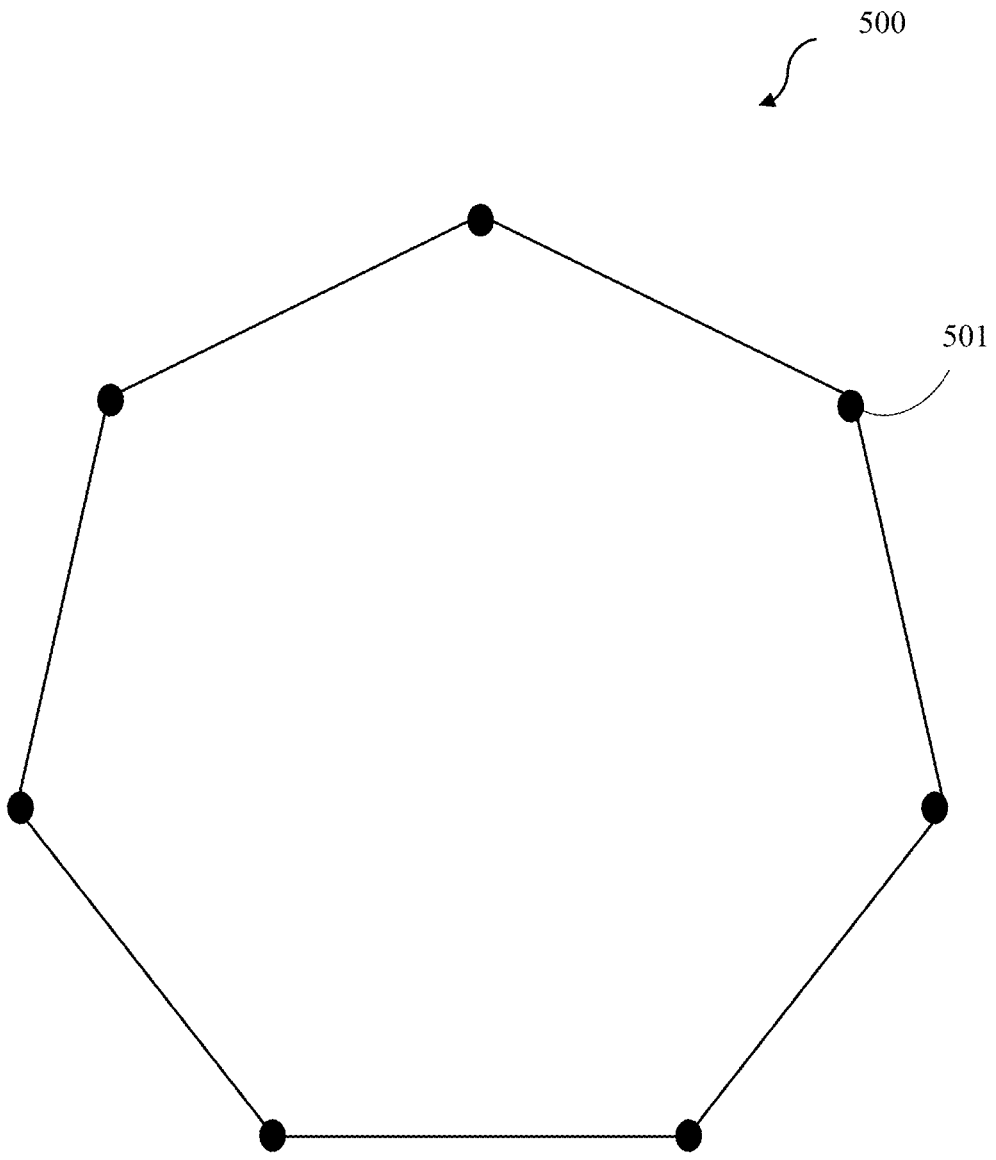
FIG. 5 illustrates a two-dimensional view 500 of the shape of each of the drums in the drum stacking assembly 100, in accordance with an embodiment of the present subject matter.

Referring now to FIG. 5, a two-dimensional view 500 of the shape of each of the drums 108 is illustrated in accordance with the present subject matter. In one embodiment, the drum stacking assembly 100 may comprise the plurality of drums 108, wherein each of the drums may be held in the plurality of grooves formed on a pallet 109. The plurality of drums 108 may be polygonal in shape, however, the drums 108 can have any other shape. The polygonal shape of the drums 108 may enable a high compressive strength to each of the drums 108. In one embodiment, a plurality of reinforcements 501 may be added at each corner of the polygonal-shaped drums 108. The said reinforcements 501 may be made in order to enable the said high compressive strength of the drums. Preferably, the reinforcements 501 may be made of polymer material or like materials, but may not be limited to said materials. The reinforcements 501 may extend from the upper surface of the drums 108 to the extreme bottom end of the drums 108 in order to form a circular shape in the inner part of the drums 108. Such inner circular shape may enable cleaning or like processes of the drums 108. The polygonal shape of the drums 108 may enable rolling of the drums over a flat surface.

Figure 3:
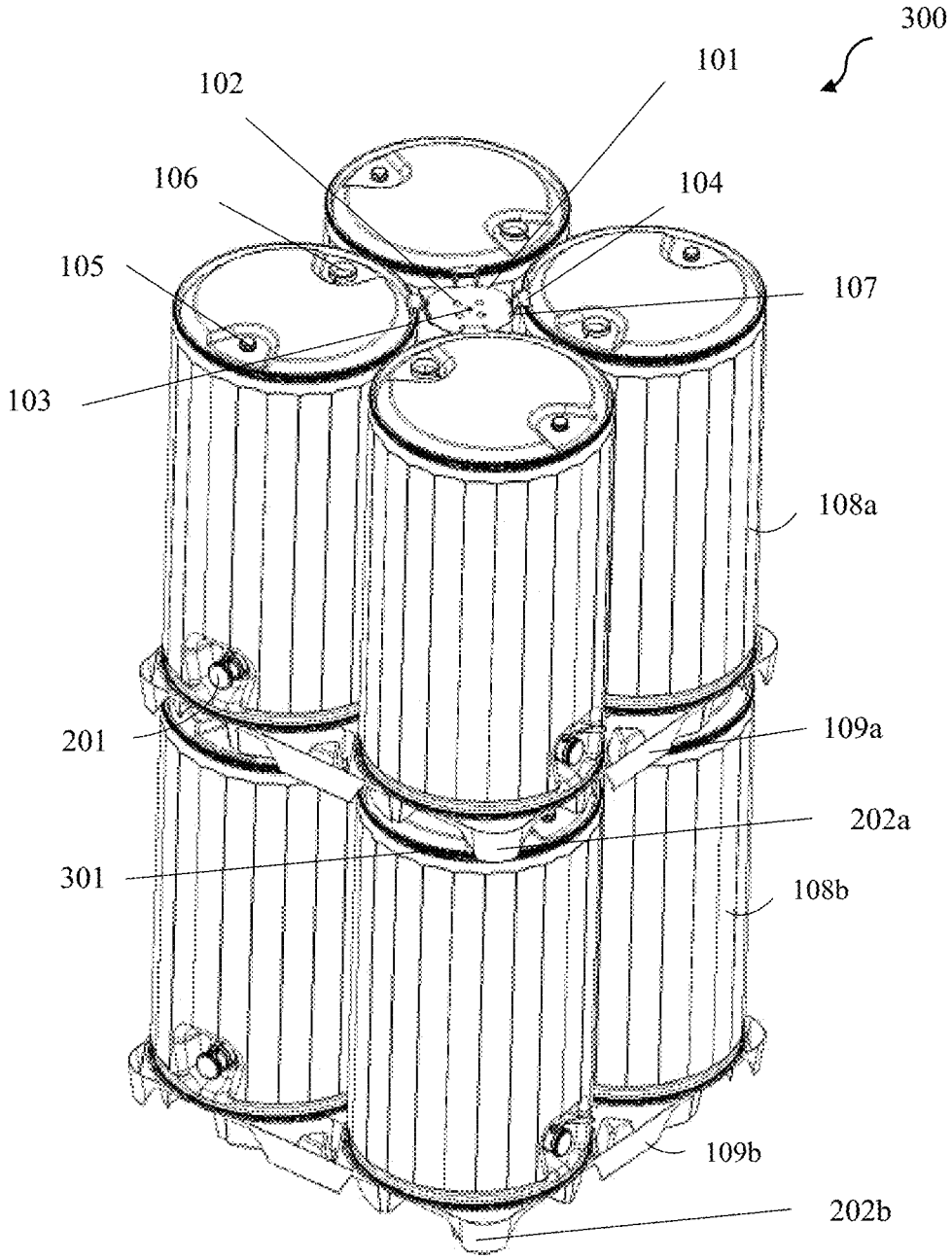
FIG. 3 illustrates a perspective view 300 of the drum stacking assembly 100 comprising multiple stacks, in accordance with an embodiment of the present subject matter.
Figure 6A:
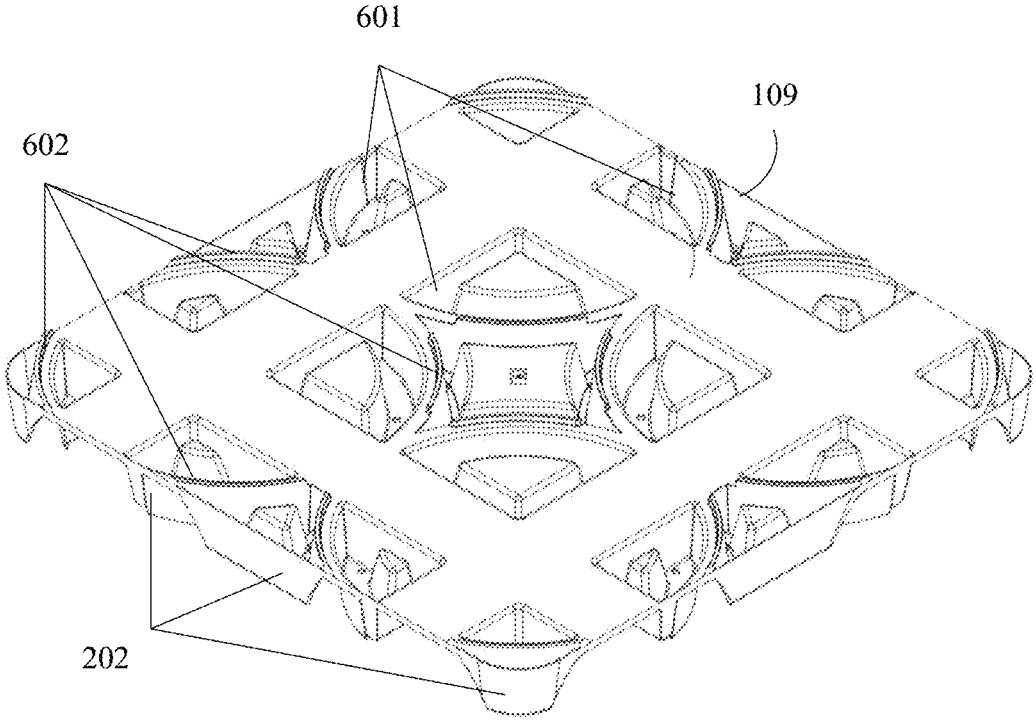
FIG. 6*a* illustrates a top view of the pallet 109 of the drum stacking assembly 100, in accordance with an embodiment of the present subject matter.
Figure 6B:
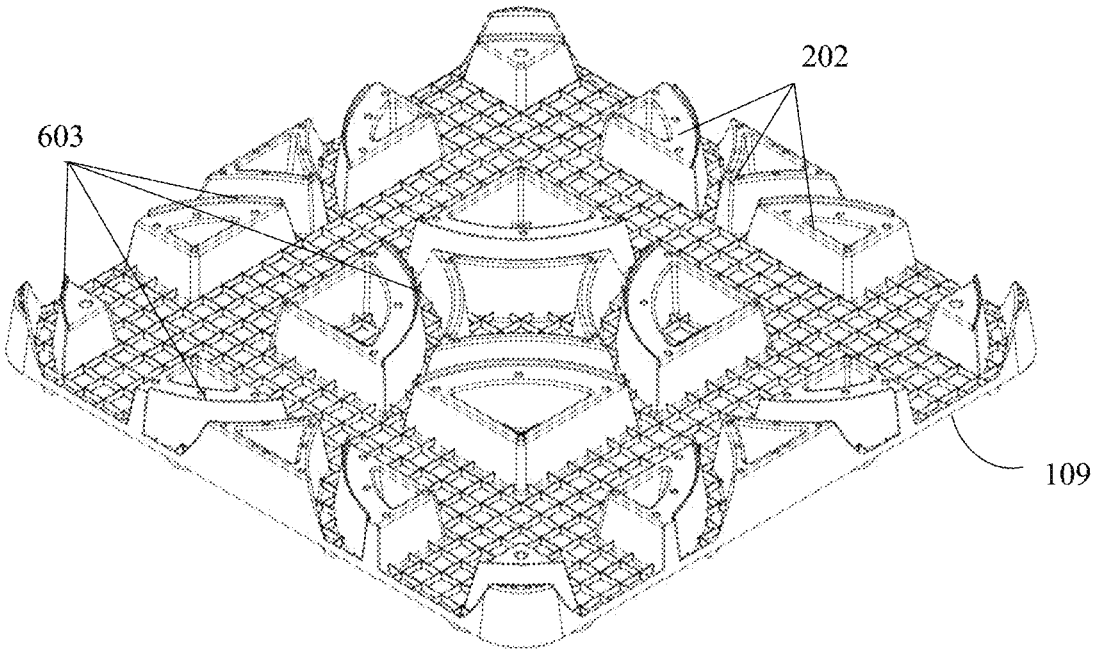
FIG. 6*b* illustrates a bottom view of the pallet 109 of the drum stacking assembly 100, in accordance with an embodiment of the present subject matter.

Referring now to FIGS. 6*a* and 6*b*, a top view and a bottom view of the pallet 109 of the drum stacking assembly 100 are illustrated, in accordance to the present subject matter. In one embodiment, as shown in FIG. 6*a*, the top surface of the pallet 109 may comprise a plurality of support shells 601. The support shells 601 may be constructed in accordance with the bottom surface of a first set drums 108*a*, of the plurality of drums 108, as shown in FIG. 3. The support shells 601 may also comprise provisions in accordance with the connector 101. In one embodiment, the plurality of support shells 601 may comprise at least a plurality of ribs 602. The said ribs 602 may be upwardly projected and adapted to support the first set of drums 108*a*. An outer reinforcing ring of the bottom surface of each of the first set of drums 108*a* may be guided in the plurality of ribs 602 in order to engage the first set of drums 108*a* with the pallet 109.

In one embodiment, as shown in FIG. 6*b*, the bottom surface of the pallet 109 may comprise a plurality of grooves 202. The grooves 202 may be formed due to the protruding of the support shells 602 and may be in accordance with the top surface of a second set drums 108*b*, of the plurality of drums 108, as shown in FIG. 3. The grooves 202 may further comprise provisions in accordance with the connector 101 and the metal insert. In one embodiment, the plurality of grooves 202 may comprise at least a plurality of indentations 603. The said indentations 603 may be downwardly projected and adapted to engage an outer reinforcing ring 301 of the upper surface of the second set of drums 108*b* thereby locking the second set of drums 108*b* with the pallet 109.

Figure 4:
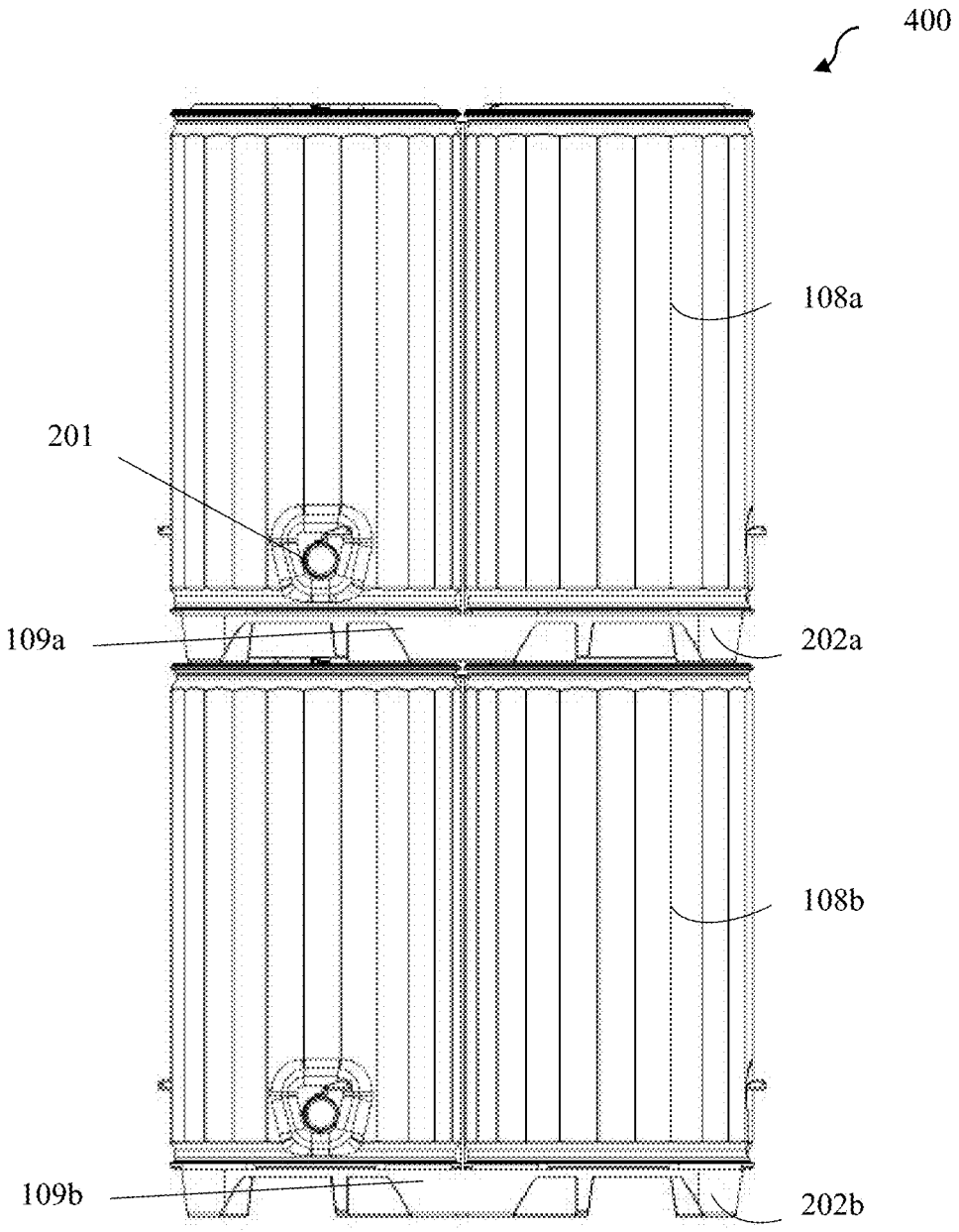
FIG. 4 illustrates a front view 400 of the drum stacking assembly 100 comprising multiple stacks, in accordance with an embodiment of the present subject matter.

Referring now to FIG. 3 and FIG. 4, a perspective view 300 and a front view 400 of the drum stacking assembly 100 comprising multiple stacks are illustrated, in accordance with embodiments of the present subject matter. In one embodiment, the drum stacking assembly 100 may comprise a multi-storied stack. The said multi-storied stack may be configured to simultaneously transport a plurality of drums 108 arranged in multiple stacks. In one embodiment, the drum stacking assembly 100 may comprise a first set of plurality of drums 108*a* positioned relative amongst each other via a first connector 101 and a second set of plurality of drums 108*b* positioned relative amongst each other via a second connector (not shown in figure). Further, the said assembly 100 may comprise the pallet 109, wherein a top surface of the pallet 109 may comprise the plurality of support shells 601 (as shown in FIG. 6*a*). The plurality of support shells 601 may comprise at least the plurality of ribs 602. The ribs 602 may be upwardly projected and adapted to support the first set of drums 108*a*. An outer reinforcing ring of the bottom surface of each of the first set of drums 108*a* may be guided in the plurality of ribs 602 in order to engage the first set of drums 108*a* with the pallet 109. The bottom surface of the pallet 109 may comprise the plurality of grooves 202, wherein the plurality of grooves 202 comprise at least the plurality of indentations 603 (as shown in FIG. 6*b*). The indentations 603 may be downwardly projected and adapted to engage an outer reinforcing ring 301 of the upper surface of the second set of drums 108*b* thereby locking the second set of drums 108*b* with the pallet 109.

In one embodiment, the drum stacking assembly 100 may comprise a first pallet 109*a* and a second pallet 109*b* (shown in FIG. 3), wherein the pallets (109*a*, 109*b*) may be stiff and quadrilateral in shape. A first stack of the drum stacking assembly 100 may comprise the first set of drums 108*a* connected amongst each other via the first connector 101. The first set of drums 108*a* may be received and supported a top surface of the first pallet 109*a*, wherein the top surface of the first pallet 109*a* may comprise the plurality of support shells 601. The plurality of support shells 601 may at least comprise the plurality of ribs 602 configured to support the first set of drums 108*a* along with the first connector 101 in order to engage the first set of drums 108*a* with the pallet 109*a*. In one embodiment, the bottom surface of the first pallet 109*a* may comprise a plurality of grooves 202*a*, wherein said plurality of grooves 202*a* may be formed by the protruding of the support shells 601 at the said top surface of the said pallet 109*a*. The plurality of grooves 202 may be configured to support the drum stacking assembly 100 in miscellaneous ways. The plurality of grooves 202*b* may comprise a plurality of indentations 603. In one embodiment, a second stack of the drum stacking assembly 100 may be comprise similar elements configured in a similar way as that of the first stack. The stacking between the first stack and the second stack of the drum stacking assembly 100 may be enabled by placing the first pallet 109*a* on the upper portion of second set of drums 108*b*, wherein the indentations 603 of first pallet 109*a* may be engaged on the outer reinforcing ring 301 of the second set of drums 108*b*. Such engagement may be adapted to lock of the said second set of drums 108*b*, wherein the outer reinforcing ring 301 of the said drums 108*b* may be partially or completely engaged with the said indentations of the said pallet 109*a*.

It must be understood to one skilled in the art that though the above embodiments illustrate and describes the stacking of drums 108 by forming two stacks using two pallets, however, the present disclosure is not limited to stacking of the drums via two stacks. In the similar manner as described above, the upper surface of the first set of drums 108*a* may be engaged in indentations of another pallet placed upon the first set of drums 108*a* thereby forming a third stack of the drum assembly. Similarly, indentations at the bottom surface of the second pallet 109*b* may be adapted to engage the outer reinforcing ring of the each of a third set of drums (not shown). Accordingly, multiple stacks may be formed to accommodate multiple drums via multiple pallets.

Figure 7A:
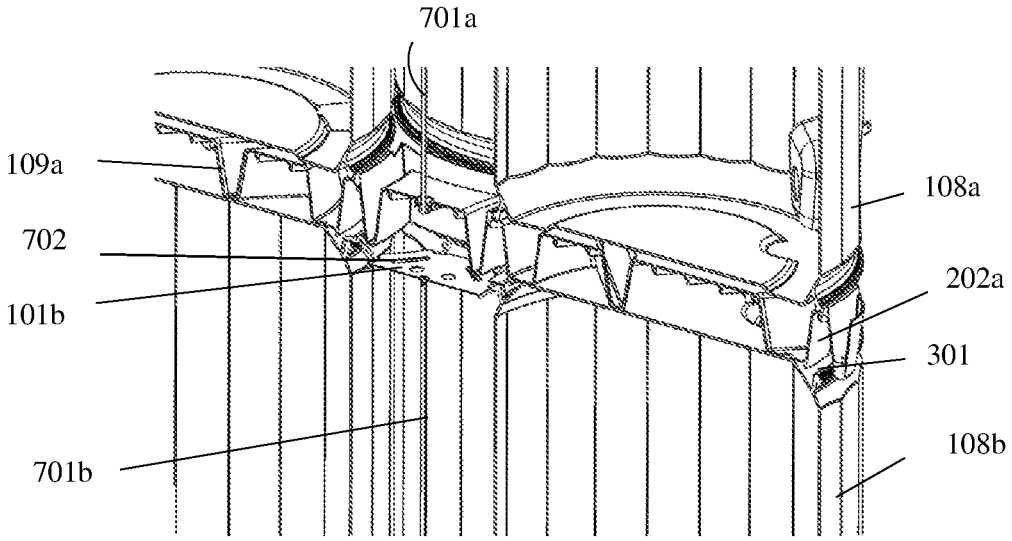
FIG. 7*a* illustrates a cross sectional view of the drum stacking assembly 100, in accordance with an embodiment of the present subject matter.
Figure 7B:
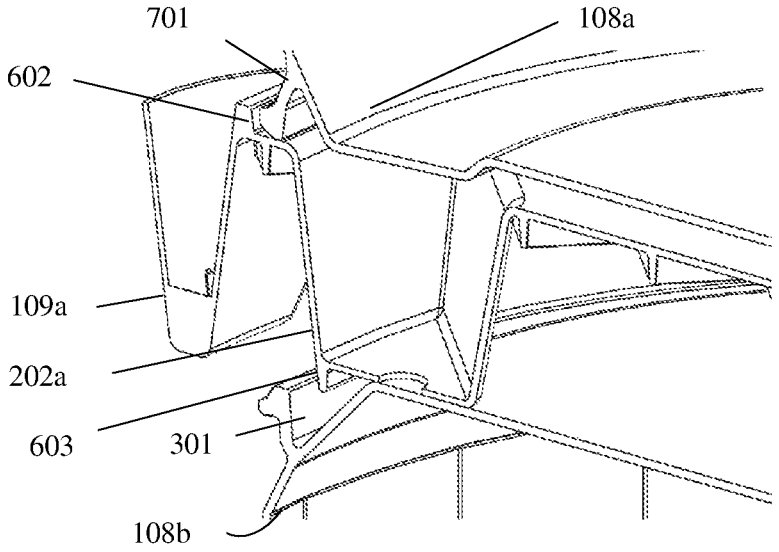
FIG. 7*b* illustrates a magnified view of engaging the pallet 109 with the drums 108 in the drum stacking assembly 100, in accordance with an embodiment of the present subject matter.

Referring now to FIG. 7*a* and FIG. 7*b*, a cross sectional view and a magnified view of the drum stacking assembly 100 depicting engagement of the upper pallet 109 with each of the drums 108 are illustrated. In one embodiment, during transportation, the plurality of drums 108 stacked may sometimes undergo lateral movement or collective lateral movement, but not limited to such movements. In one embodiment, the lateral movement may occur due to off positioning of a single drum in the pallet 109*a*. Such movement may make the whole drum stacking assembly 100 unstable. In one embodiment, the collective lateral movement may occur due to off positioning of a plurality of drums 108*a* in the pallet 109*a*. Such off positioning of one or more drums may occur during transportation due to various factors including, but not limited to, uneven roads, speed breakers and the like. In one embodiment, the drum stacking assembly 100 enables the stacking of plurality of drums 108*a* by engaging a predefined portion of the pallet 109*a* on the outer reinforcing ring of the multiple drums 108*b* below wherein the pallet 109*a* may be grooved in accordance with the successive drums 108*b* below. Such stacking enables to overcome the disturbances caused due to off positioning of the drums.

In another embodiment, the drum stacking assembly 100 may overcome the said technical problem of off positioning of drums by using the connector. In one embodiment, the first connector (not shown in figure) may enable connection amongst the first set of drums 108*a* placed in the pallet 109*a*, wherein the connector may be fixed in the pallet 109*a* such that the plurality of drums 108*a* may be surrounded around the connector. In one embodiment, the outer reinforcing ring 701 of the bottom surface of each of the first set of drums 108*a* may be supported by an upwardly projected rib from plurality of ribs 602 of the first pallet 109*a*. In one embodiment, similarly in a second stack, the outer reinforcing ring 301 of a drum from the second set of drums 108*b* may be engaged with the indentations from the plurality of indentations 603 of the first pallet 109*a*. The second connector 101*b* may be placed at a predetermined distance from the top of the second set of plurality of drums 108*b*. The pallet 109*a* may be molded in accordance to the second connector 101*b* wherein the second connector 101*b* may lie under the central support shell of the pallet 109. In one embodiment, the screw-rod 701*a* of the first connector may be fitted on the pallet 109*a* with the help of a metal insert. In one embodiment, a metal insert may be fitted below the pallet 109 during molding of the pallet 109*a*.

In one embodiment, the plurality of drums 108, the connector 101, and the pallet 109 may made from of material such as polymer, metal or any like material, but may not be limited to said material and dimensions. The said plurality of drum stacking assembly 100 may be economic, flexible, lightweight, nearly unbreakable and having a high tensile and stress carrying capacity. The drum stacking assembly 100 may enable stable stacking eliminating the drawbacks of conditions wherein the plurality of drums 108 may collapse under various conditions.

Figure 8:
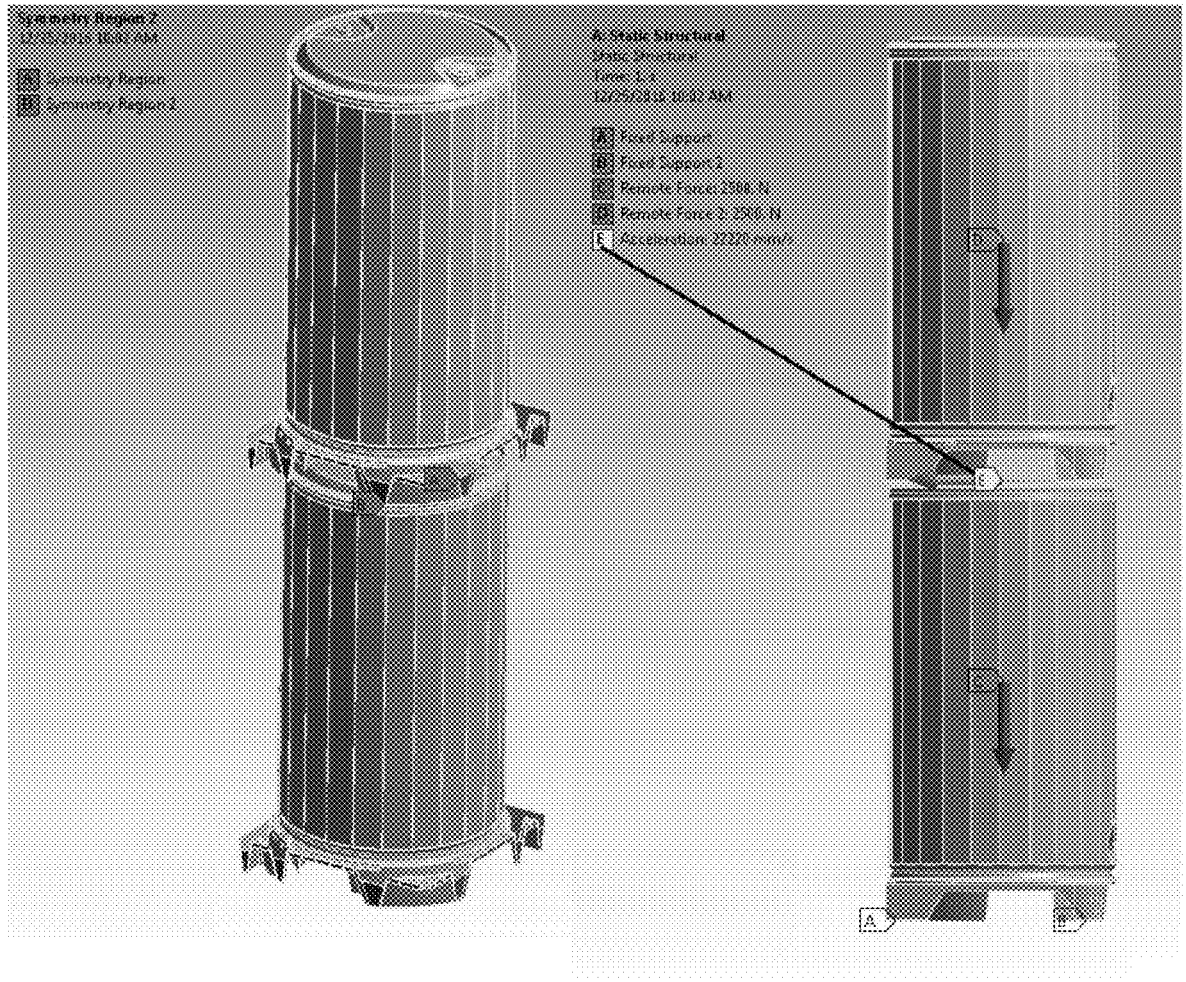
FIG. 8 illustrates a boundary conditions or test criteria set for conducting dynamic test analysis of drum stacking assembly 100, in accordance with an embodiment of the present subject matter.

Referring now to FIG. 8 to FIG. 17, results of dynamic testing analysis of the drum assembly verifying the properties of the drums and the pallets in the drum assembly are illustrated, in accordance with embodiments of the present subject matter. FIG. 8 illustrates a boundary conditions or test criteria set for conducting dynamic test analysis of drum stacking assembly 100, in accordance with an embodiment of the present subject matter. In one embodiment, the boundary conditions or the test criteria for the dynamic testing may include, but not limited to, 100% of the drums 108 being filled, four drums 108 being stacked on the pallet 109, symmetry of the geometry being used, the drum stack assembly 100 being exposed to acceleration of 80 km/hr. In one embodiment, assumptions considered for the dynamic test may further include, but not limited to, considering material and geometrical nonlinearity. Further, acceptance criteria for the test may include strain as permitted. In one embodiment, the material data for the dynamic stacking test may include Young's modulus: at least 1850 MPa, Poisson ratio: typically, around at least 0.40-0.45, Density: at least 0.953 g/cm3, Yield stress: at least 27 MPa.

As shown in FIG. 8 (left half), two symmetry regions namely a symmetry region (indicated as A) and symmetry region 2 (indicated as B) may be defined. Further, as shown in FIG. 8 (right half) each of the two drums may be applied with a force (indicated with arrows C and D) of 2500 N and an acceleration of 22220 mm/s may be applied for facilitating dynamic testing of the drums. Further, as shown in FIG. 8 (right half), structures of below pallet holding the lower drum may be fixed and are not movable.

Figure 9:
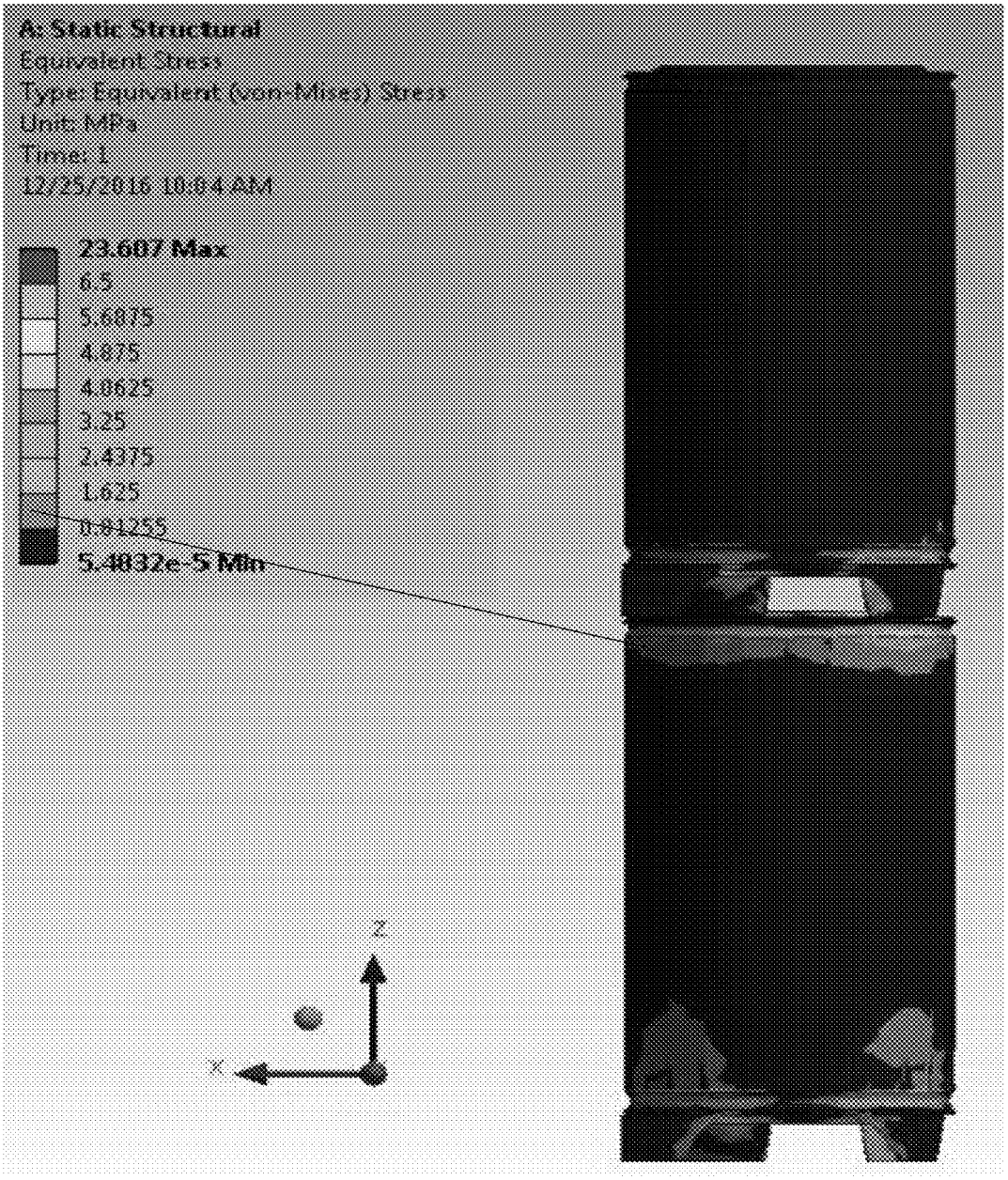
FIG. 9 illustrates a result of the dynamic test analysis depicting maximum stress observed in the drum stacking assembly 100, in accordance with an embodiment of the present subject matter.

Now, referring to FIG. 9, a result of the dynamic test analysis depicting maximum stress observed in the drum stacking assembly 100 is illustrated. In one embodiment, a stress level of 0.81255 Mpa may be observed pertaining to a section of the drum (as indicated with an arrow directing to a light blue color in a scale depicted in left-half of FIG. 9). Similarly, other sections of the drum may be susceptible to stresses of different values (indicated with different colors as per the scale). It is observed from FIG. 9 that maximum stress obtained for the drum is 23.6 Mpa.

Figure 10:
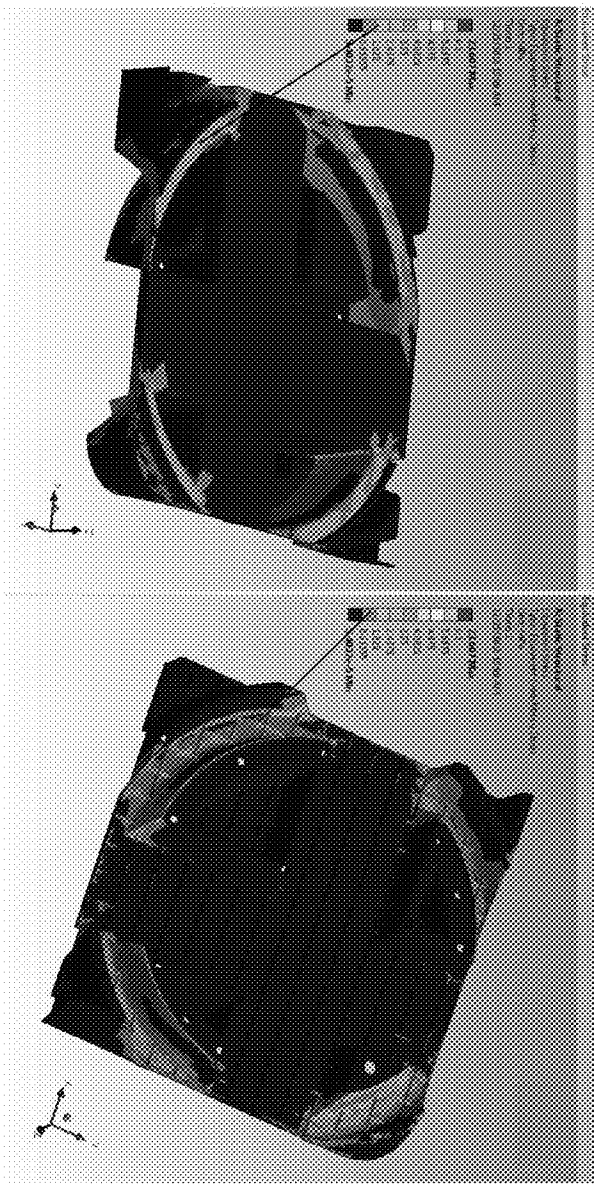
FIG. 10 illustrates a result of the dynamic test analysis depicting maximum stress observed in a lower pallet of the drum stacking assembly 100, in accordance with an embodiment of the present subject matter.

FIG. 10 illustrates a result of the dynamic test analysis depicting maximum stress observed in a lower pallet of the drum stacking assembly 100, in accordance with an embodiment of the present subject matter. In one embodiment, one of the stress levels at the top surface and the upper surface of the lower pallet having values of 1.625 and 0.81255, respectively, is depicted. Similarly, other values of the stress levels (indicated with different colors as per the scale) at different portions of the upper and bottom surfaces of the lower pallet may be obtained. It is observed from FIG. 10 that maximum stress obtained for the lower pallet is 23.6 Mpa.

Figure 11:
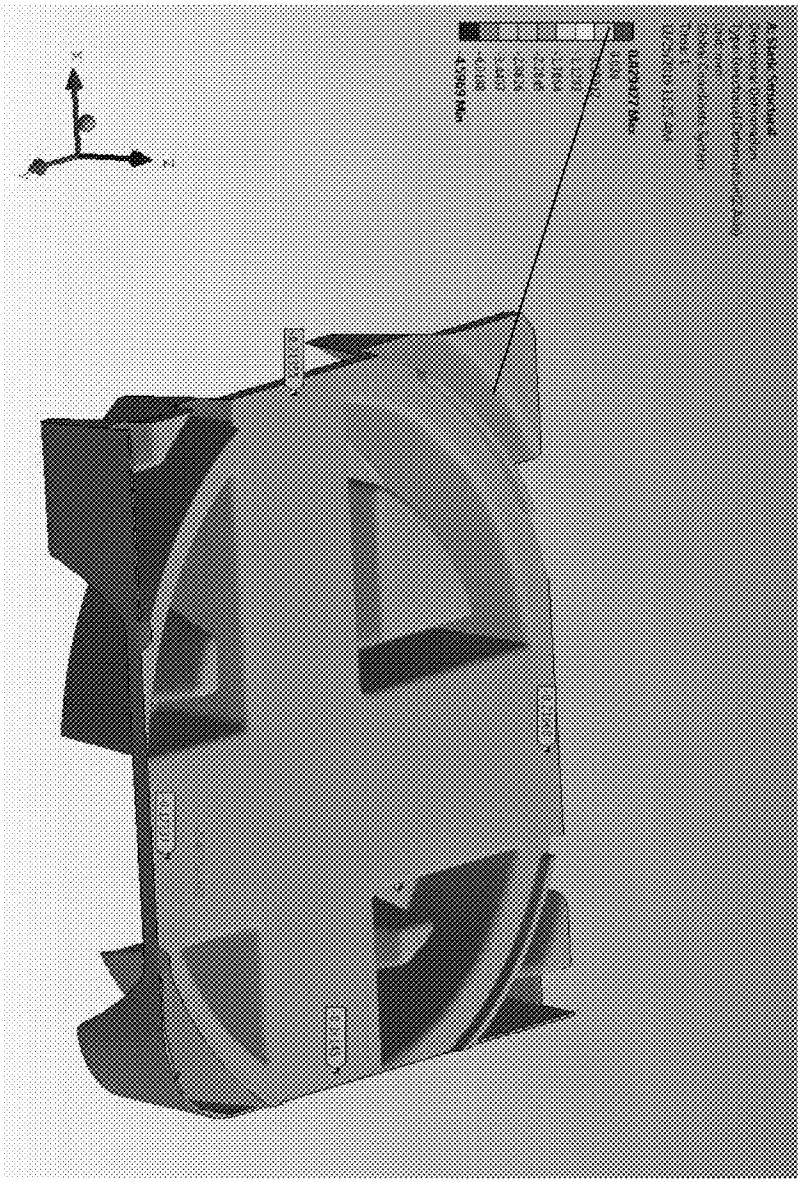
FIG. 11 illustrates a result of the dynamic test analysis depicting deformation of the lower pallet, in accordance with an embodiment of the present subject matter.

FIG. 11 illustrates a result of the dynamic test analysis depicting deformation of the lower pallet, in accordance with an embodiment of the present subject matter. In one embodiment, a deformation of 0.028 may be depicted. Further, various deformations (indicated with different colors as per the scale) at different portions of the lower pallet may be obtained. The directional deformation type result may be obtained. A deformation of 0.21 mm may be obtained on the lower pallet.

Figure 12:
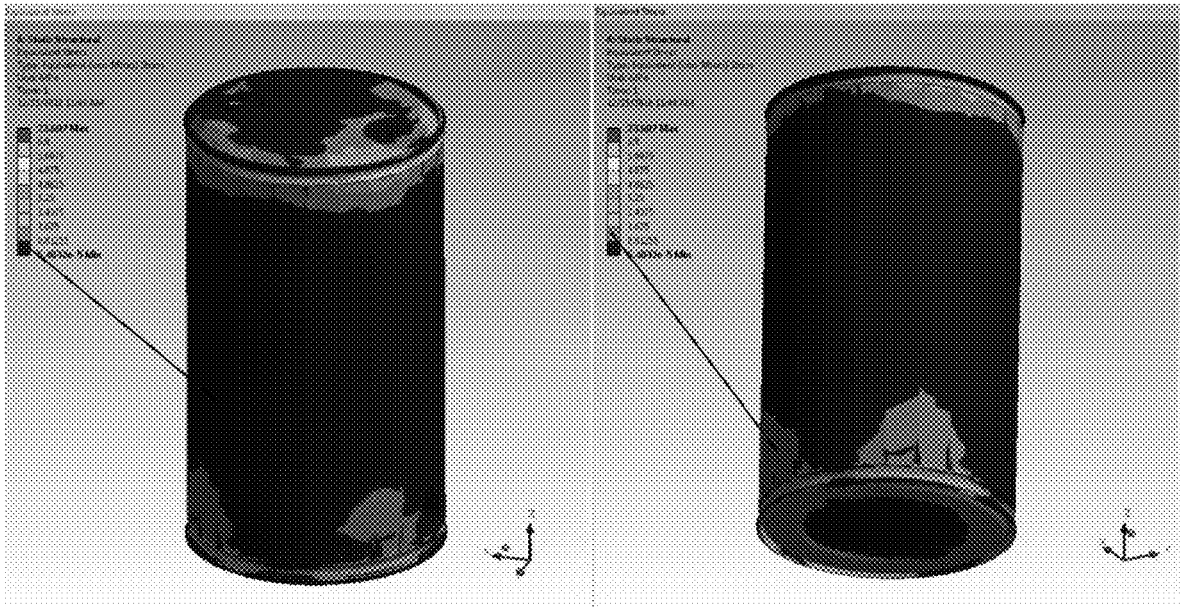
FIG. 12 illustrates a result of the dynamic test analysis depicting maximum stress observed in a lower drum of the drum stacking assembly 100, in accordance with an embodiment of the present subject matter.

FIG. 12 illustrates a result of the dynamic test analysis depicting maximum stress observed in a lower drum of the drum stacking assembly 100, in accordance with an embodiment of the present subject matter. In one embodiment, the stress levels at two different surfaces (shown in two different halves of FIG. 12) of the lower drum are having values of 5.4832e−5 and 0.81255, respectively, may be obtained. Similarly, other values of the stress levels (indicated with different colors as per the scale) at different portions of the lower drum may be obtained. It is observed from FIG. 12 that maximum stress obtained for the lower drum is 23.6 Mpa.

Figure 13:
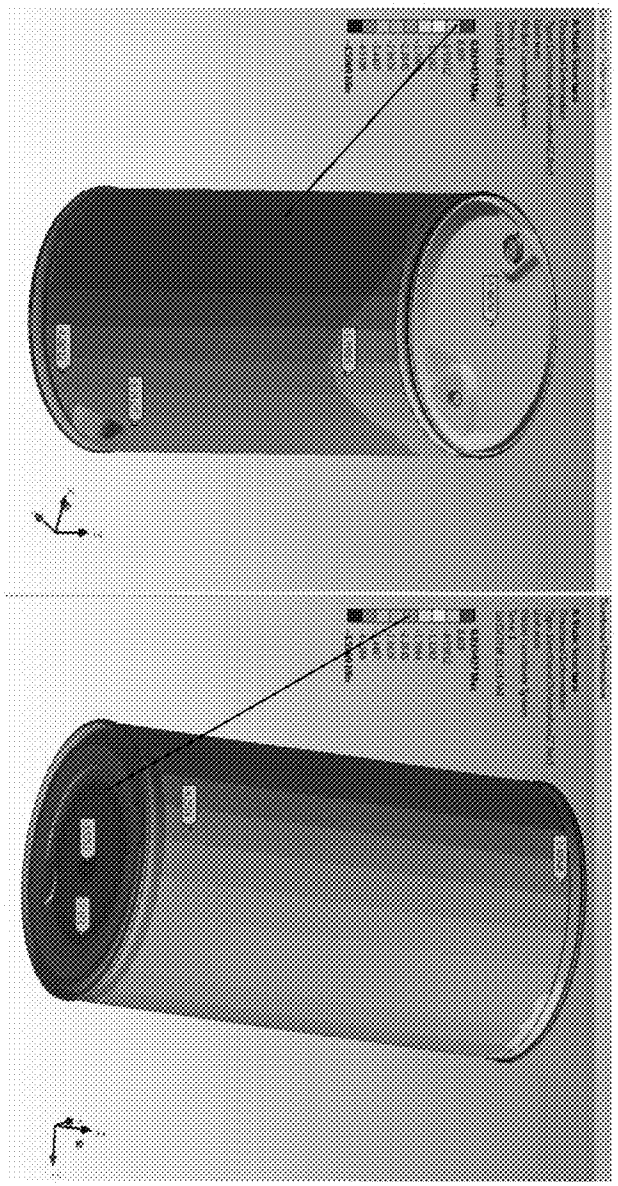
FIG. 13 illustrates a result of the dynamic test analysis depicting deformation of the lower drum, in accordance with an embodiment of the present subject matter.

FIG. 13 illustrates a result of the dynamic test analysis depicting deformation of the lower drum, in accordance with an embodiment of the present subject matter. In one embodiment, a deformation of 0.028 and −2.2845 may be obtained pertaining to two different sections of the lower drum. Similarly, deformations for the other sections of the lower drum may be observed. A maximum deformation of 3.57 mm may be obtained on the lower drum.

Figure 14:
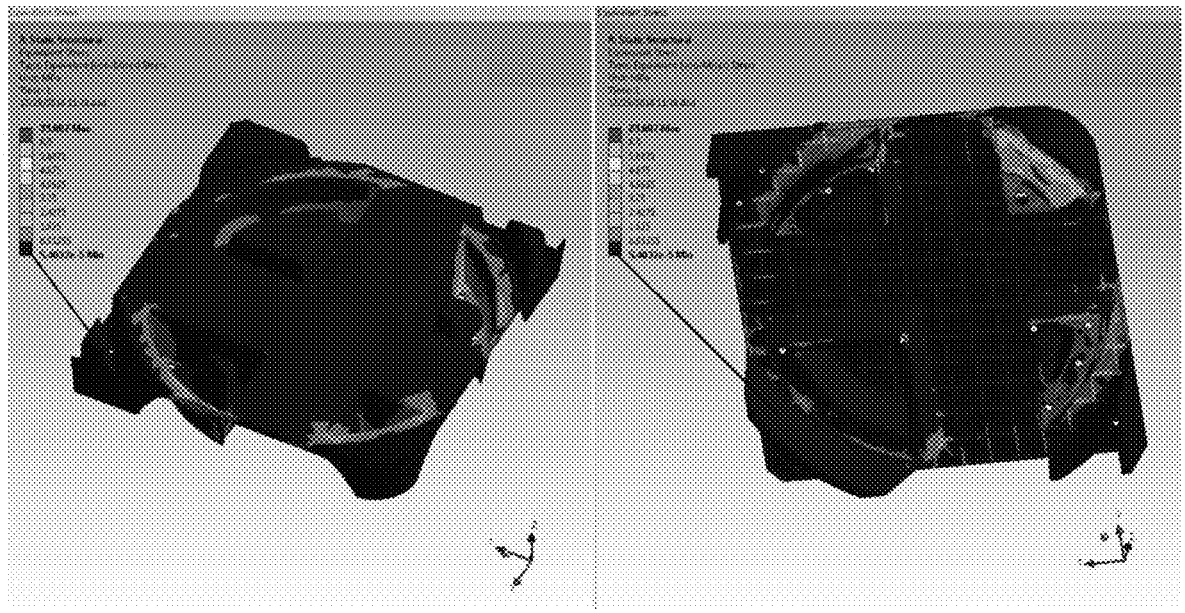
FIG. 14 illustrates a result of the dynamic test analysis depicting maximum stress in an upper pallet of the drum stacking assembly 100, in accordance with an embodiment of the present subject matter.

FIG. 14 illustrates a result of the dynamic test analysis depicting maximum stress in an upper pallet of the drum stacking assembly 100, in accordance with an embodiment of the present subject matter. In one embodiment, a stress level of 5.4832e−5 may be obtained as depicted with an arrow to one of the colors in the scale. Further stress levels (indicated with different colors as per the scale) pertaining to different sections of the upper pallet may be obtained. In an embodiment, a maximum stress level of 23.6 Mpa may be obtained on the upper pallet.

Figure 15:
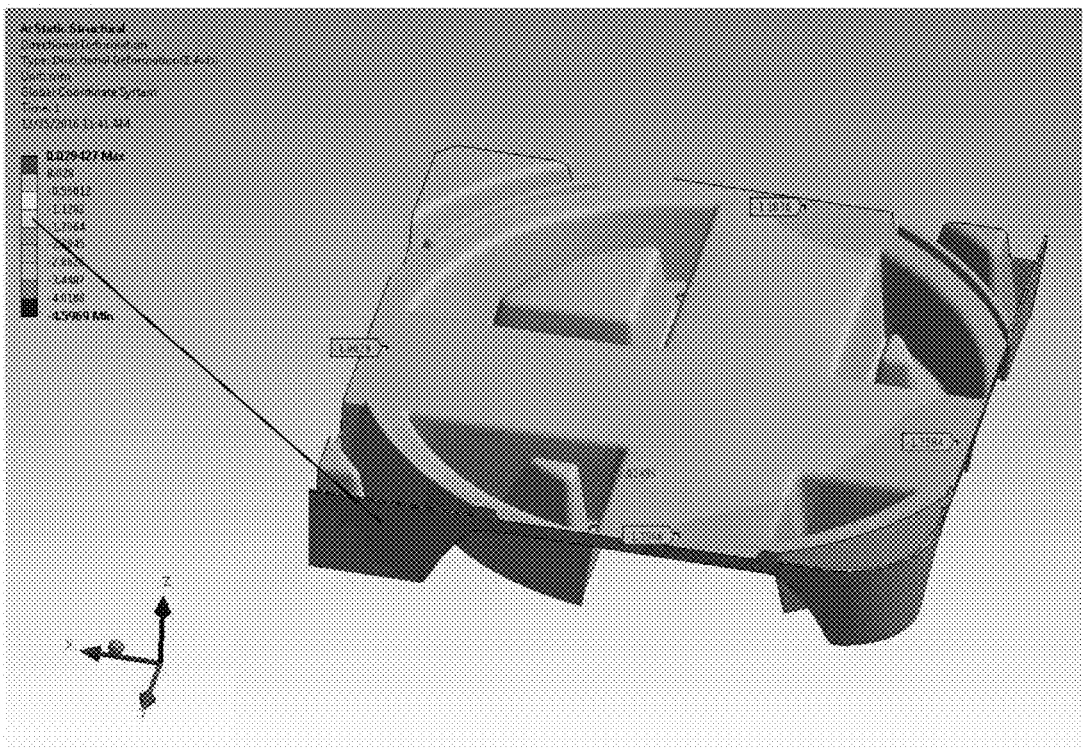
FIG. 15 illustrates a result of the dynamic test analysis depicting deformation of the upper pallet, in accordance with an embodiment of the present subject matter.

FIG. 15 illustrates a result of the dynamic test analysis depicting deformation of the upper pallet, in accordance with an embodiment of the present subject matter. In one embodiment, a deformation of −1.1282 may be obtained. Further, the deformations may be obtained similarly. In an embodiment, a maximum deformation of 1.35 mm may be obtained on upper pallet.

Figure 16:
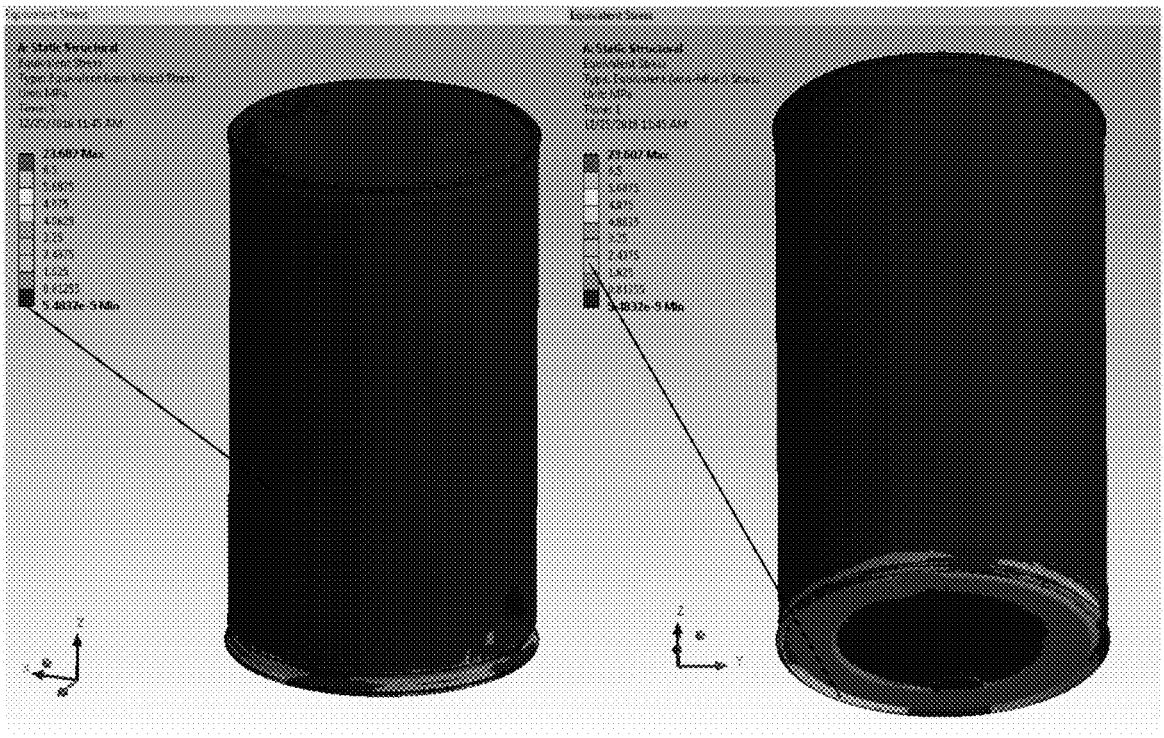
FIG. 16 illustrates a result of the dynamic test analysis depicting maximum stress observed in an upper drum of the drum stacking assembly 100, in accordance with an embodiment of the present subject matter.

FIG. 16 illustrates a result of the dynamic test analysis depicting maximum stress observed in an upper drum of the drum stacking assembly 100, in accordance with an embodiment of the present subject matter. In one embodiment, a stress level of 5.4032e−5 and 1.625 may be obtained pertaining to two different sections of the upper drum. Further, the stress levels for the different portions of the upper drum may be obtained similarly. In an embodiment, a maximum stress level of 23.6 Mpa may be obtained on the upper drum.

Figure 17:
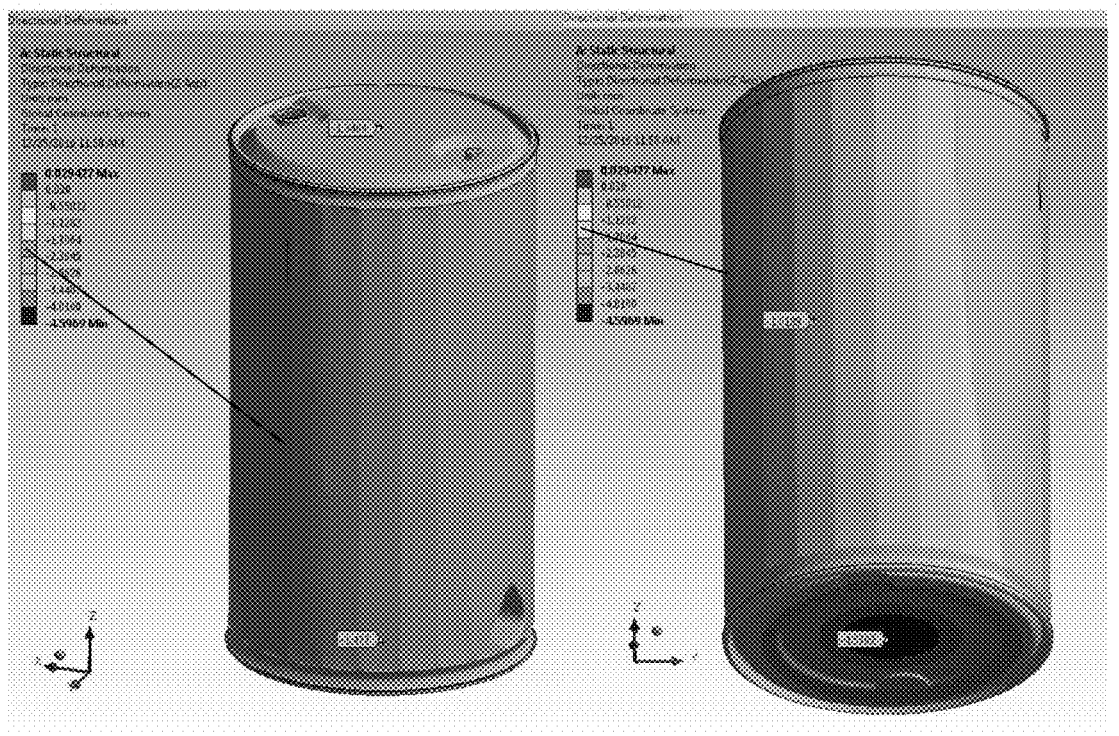
FIG. 17 illustrates a result of the dynamic test analysis depicting deformation of the upper drum, in accordance with an embodiment of the present subject matter.

FIG. 17 illustrates a result of the dynamic test analysis depicting deformation of the upper drum, in accordance with an embodiment of the present subject matter. In one embodiment, a deformation of −1.1282 may be obtained pertaining to two different sections of the upper drum. Further, the deformations for the different portions of the upper drum may be obtained similarly. In an embodiment, a maximum deformation of 4.57 mm may be obtained on upper drum.

Based upon the dynamic test results noted above, it can be concluded that the maximum stress induced in the drum stacking assembly is 23.6 Mpa which is less than yield and at very less concentrated areas. Further, overall stress in the drums 108 is not more than 10 Mpa which is very less than the yield of 27 Mpa. Further, maximum deformation of only 4.5 mm is observed at the bottom of the drums 108. Hence, it must be understood that the drums 108 are safe to withstand the dynamic loading.

Figure 18A:
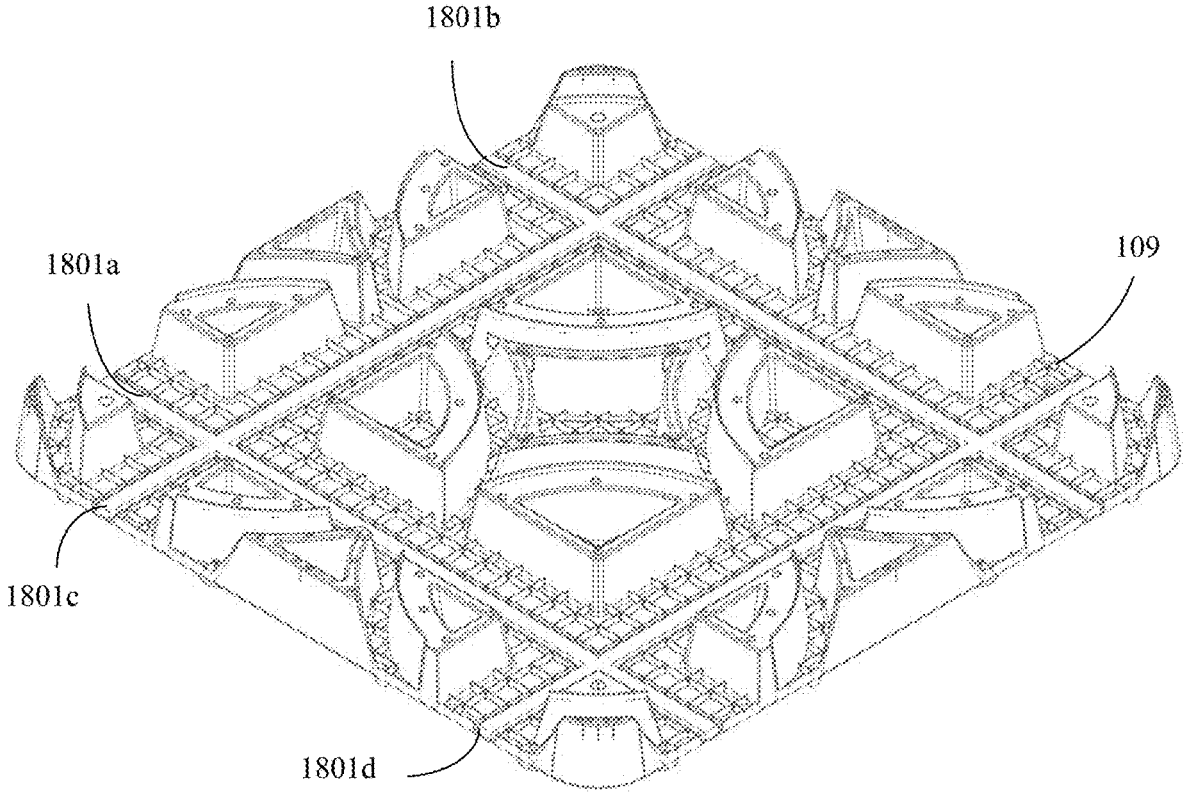
FIG. 18*a* and FIG. 18*b* illustrates bottom and top isometric views of the pallet 109 with metal reinforcements 1801*a*, 1801*b*, 1801*c*, 1801*d*.
Figure 19A:
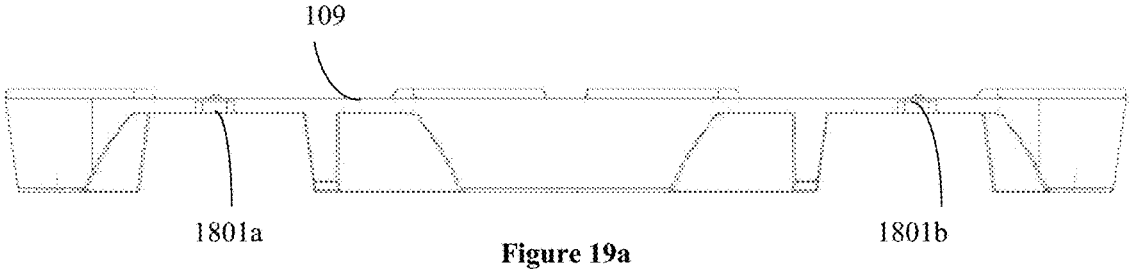
FIG. 19*a* and FIG. 19*b* illustrates front and bottom view of the pallet 109 with metal reinforcements 1801*a*, 1801*b*, 1801*c*, 1801*d*.
Figure 19B:
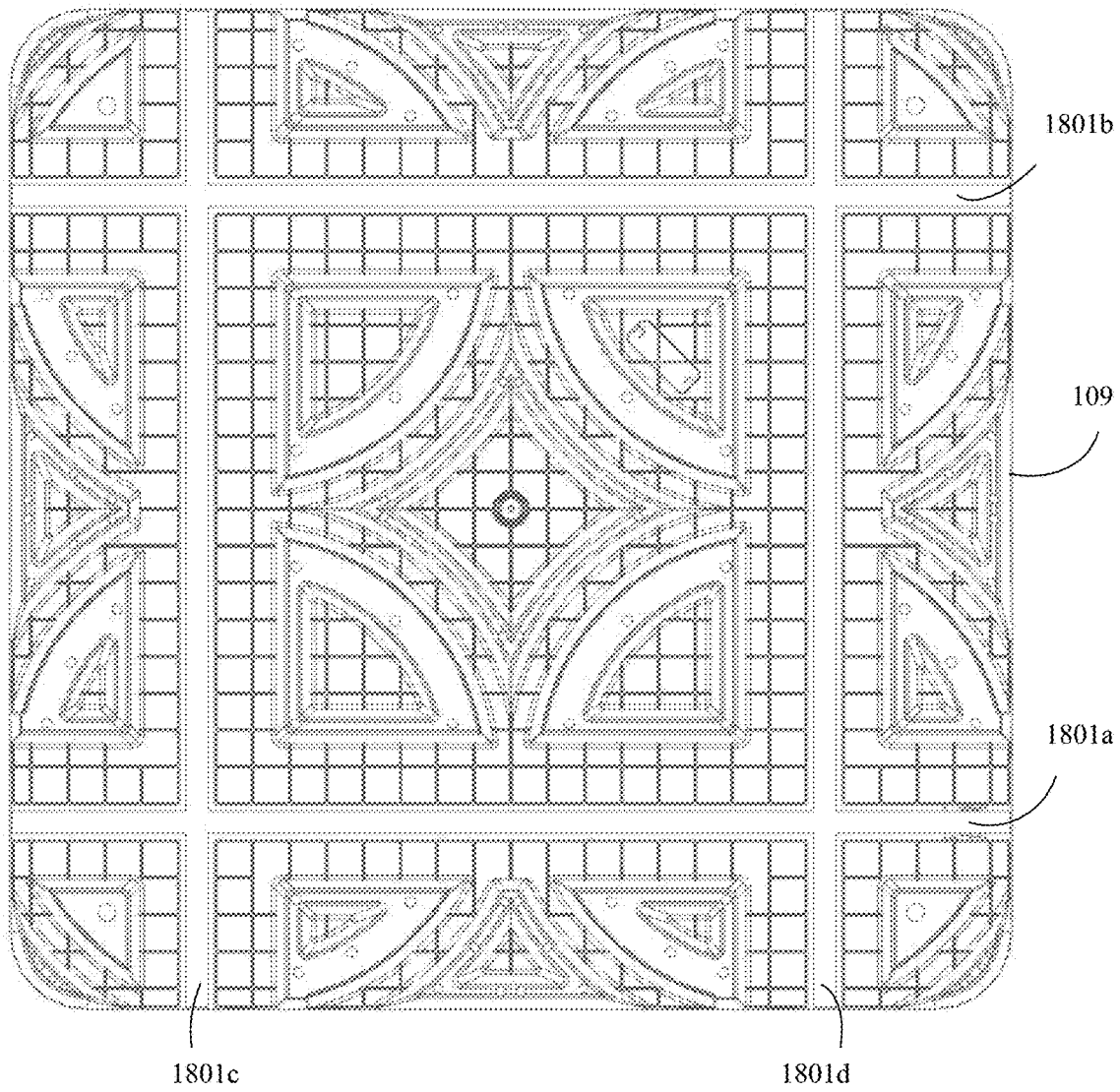
Figure 20:
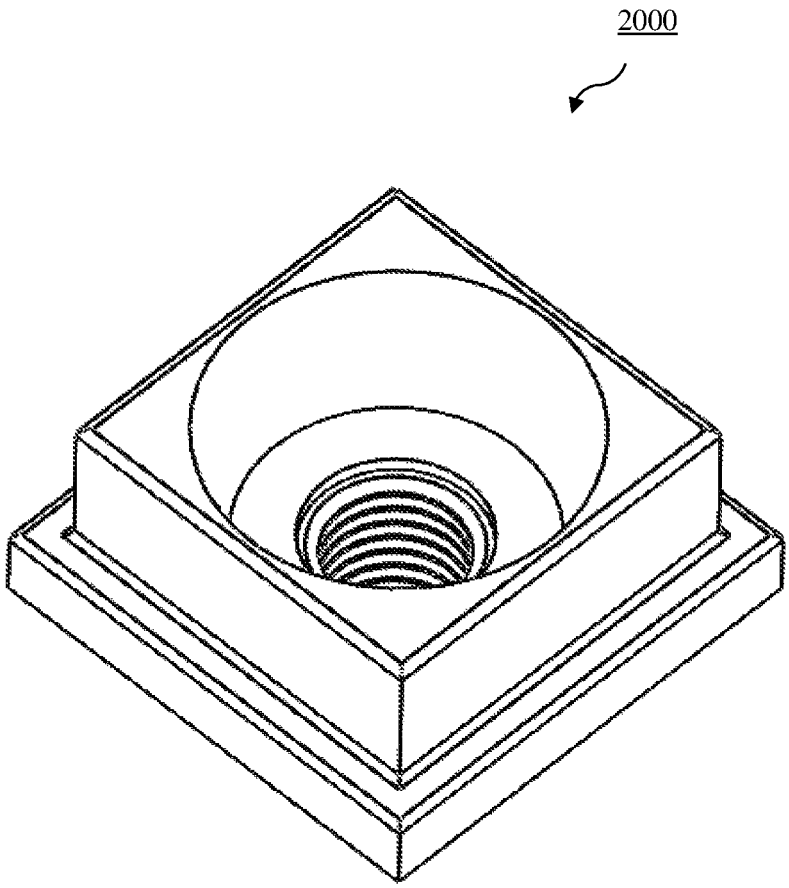

FIGS. 18*a* and 19*b* illustrate the bottom views of the pallet 109 with optionally including metal reinforcements 1801*a*, 1801*b*, 1801*c*, 1801*d* respectively. In one embodiment, the pallet 109 may optionally comprise metal reinforcements 1801*a*, 1801*b*, 1801*c* and 1801*d*, wherein said metal reinforcements may provide extended support to the pallet 109. The support may enable the pallet 109 to remain stiff in spite of the weight of the load on the pallet 109 thereby avoiding sagging of the pallet 109. In one embodiment the metal reinforcements 1801*a*, 1801*b*, 1801*c*, 1801*d* may be of steel. Further said metal reinforcements 1801*a*, 1801*b*, 1801*c*, 1801*d* may be optionally inserted as per requirement.

Figure 18B:
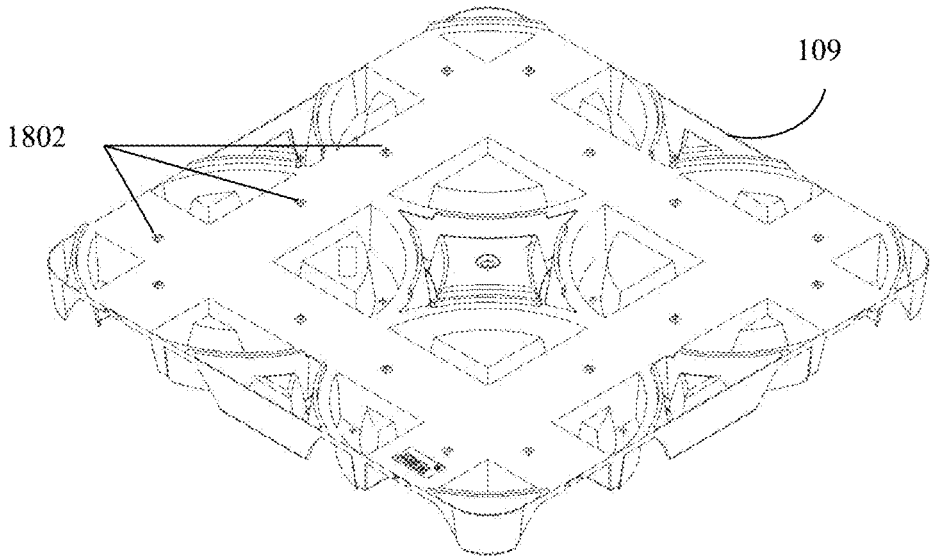

FIGS. 18*b* and 19*a* illustrate top and front view of the pallet 109 respectively. The front view 19*a* illustrates the metal reinforcements 180*a* and 1801*b* placed at the bottom of the pallet 109. In one embodiment, as shown in FIG. 18*a* (i.e. top view of the pallet), the pallet 109 may comprise a plurality of fixing means 1802 on the top surface, in order to enable fixing of said metal reinforcements 1801*a*, 1801*b*, 1801*c*, 1801*d* at the bottom of the pallet 109. In one exemplary embodiment, the fixing means 1802 may include, but not limited to, one or more of screws, nut bolts, rivets, and the like.

Although implementations of a drum stacking assembly have been described in language specific to structural features and/or methods, it is to be understood that the appended claims are not necessarily limited to the specific features or methods described. Rather, the specific features are disclosed as examples of the drum stacking assembly.

The invention claimed is:

1. A drum stacking assembly (100), comprising: a first set of drums (108*a*) positioned relative to each other via a first connector (101); a second set of drums (108*b*) positioned relative to each other via a second connector; and a pallet (109), wherein a top surface of the pallet (109) comprises a plurality of support shells (601), wherein the plurality of support shells (601) comprise at least a plurality of ribs (602), upwardly projected, adapted to support the first set of drums (108*a*), wherein an outer reinforcing ring of the bottom surface of the first set of drums (108*a*) is guided by the plurality of ribs (602) in order to engage the first set of drums (108*a*) with the pallet (109), and wherein the bottom surface of the pallet (109) comprises a plurality of grooves (202) formed due to protruding of the plurality of support shells (601) from the top surface to the bottom surface of the pallet (109), wherein the plurality of grooves (202) comprise at least a plurality of indentations (603), downwardly projected, adapted to engage an outer reinforcing ring (301) of the upper surface of the second set of drums (108*b*) thereby locking the second set of drums (108*b*) with the pallet (109), wherein said pallet 109 comprises one or more metal reinforcements (1801*a*), (1801*b*), (1801*c*), (1801*d*) of steel arranged in a mesh structure in order to form a plurality of perpendicular intersects, thereby enabling the metal reinforcements (1801*a*), (1801*b*), (1801*c*), (1801*d*) to provide an extended support to the pallet (109) depending upon the weight of load on the pallet (109), wherein the metal reinforcements (1801*a*), (1801*b*), (1801*c*), (1801*d*) are provided below the pallet (109) in a manner such that each metal reinforcement of the plurality of reinforcements (1801*a*), (1801*b*), (1801*c*), (1801*d*) is positioned within a portion, of the pallet (109), that spaces one or more grooves of the plurality of grooves (202) from one or more other grooves of the plurality of grooves (202).

2. The drum stacking assembly (100) of claim 1, wherein the plurality of support shells is configured to provide support to the bottom surface of the first set of drums (108*a*).

3. The drum stacking assembly (100) of claim 1, wherein the plurality of grooves is configured to support the upper surface of second set of drums (108*b*).

4. The drum stacking assembly (100) of claim 1, wherein the first connector (101) is polygonal in shape.

5. The drum stacking assembly (100) of claim 4, wherein the first connector (101) comprises a plurality of U-shaped clamping means (104) connected at multiple edges of the first connector (101), wherein the clamping means (104) are connected to the first connector (101) via plurality of coupling means (107) for enabling clamping of the first connector (101) with the plurality of drums (108), wherein the plurality of coupling means (107) separates the first connector (101) from the plurality of clamping means (107) in order to enable flexible clamping of the first set of drums (108*a*) and thereby preventing the off-positioning of the first set of drums (108*a*) during stacking, and wherein a clamping means of the plurality of clamping means (104), separated via a coupling means of the plurality of coupling means (107), is adapted to clamp an outer reinforcing ring a drum of the set of drums (108*a*) from both inside and outside of the outer reinforcing ring.

6. The drum stacking assembly (100) of claim 1, wherein each of the first set of drums (108*a*) and the second set of drums (108*b*) is polygonal in shape thereby providing a high compressive strength to each of the drums (108).

7. The drum stacking assembly (100) of claim 5, wherein the plurality of drums (108), the first connector (101) and the pallet (109) are made from a material selected from a group comprising a metal and a polymer.

8. A drum stacking assembly (100) comprising: a first set of plurality of drums (108*a*) positioned relative to each other and a second set of plurality of drums (108*b*) positioned relative to each other; and a pallet (109), wherein a top surface of the pallet (109) comprises a plurality of support shells (601), wherein the plurality of support shells (601) comprise at least a plurality of ribs (602), upwardly projected, adapted to support the first set of drums (108*a*), wherein an outer reinforcing ring of the bottom surface of the first set of drums (108*a*) is guided in the plurality of ribs (602) in order to engage the first set of drums (108*a*) with the pallet (109), and wherein the bottom surface of the pallet (109) comprises a plurality of grooves (202) formed due to protruding of the plurality of support shells (601) from the top surface to the bottom surface of the pallet (109), wherein the plurality of grooves (202) comprise at least a plurality of indentations (603), downwardly projected, adapted to engage an outer reinforcing ring (301) of the upper surface of the second set of drums (108*b*) thereby locking the second set of drums (108*b*) with the pallet (109), wherein said pallet (109) comprises one or more metal reinforcements (1801*a*), (1801*b*), (1801*c*), (1801*d*) of steel arranged in a mesh structure in order to form a plurality of perpendicular intersects, thereby enabling the metal reinforcements (1801*a*), (1801*b*), (1801*c*), (1801*d*) to provide an extended support to the pallet (109) depending upon the weight of load on the pallet (109), wherein the metal reinforcements (1801*a*), (1801*b*), (1801*c*), (1801*d*) are provided below the pallet (109) in a manner such that each metal reinforcement of the plurality of reinforcements (1801*a*), (1801*b*), (1801*c*), (1801*d*) is positioned within a portion, of the pallet (109), that spaces one or more grooves of the plurality of grooves (202) from one or more other grooves of the plurality of grooves (202).

9. A pallet (109) for supporting a plurality of drums, wherein a top surface of the pallet (109) further comprises a plurality of support shells (601), wherein the plurality of support shells (601) comprise at least a plurality of ribs (602), upwardly projected, adapted to support a first set of drums (108*a*), wherein an outer reinforcing ring of the bottom surface of the first set of drums (108*a*) is guided by the plurality of ribs (602) in order to engage the first set of drums (108*a*) with the pallet (109), and wherein a bottom surface of the pallet (109) further comprises a plurality of grooves (202) formed due to protruding of the plurality of support shells (601) from the top surface to the bottom surface of the pallet (109), wherein the plurality of grooves (202) comprise at least a plurality of indentations (603), downwardly projected, adapted to engage an outer reinforcing ring (301) of the upper surface of a second set of drums (108*b*) thereby locking the second set of drums (108*b*) with the pallet (109), wherein said pallet (109) comprises one or more metal reinforcements (1801*a*), (1801*b*), (1801*c*), (1801*d*) of steel arranged in a mesh structure in order to form a plurality of perpendicular intersects, thereby enabling the metal reinforcements (1801*a*), (1801*b*), (1801*c*), (1801*d*) to provide an extended support to the pallet (109) depending upon the weight of load on the pallet (109), wherein the metal reinforcements (1801*a*), (1801*b*), (1801*c*), (1801*d*) are provided below the pallet (109) in a manner such that each metal reinforcement of the plurality of reinforcements (1801*a*), (1801*b*), (1801*c*), (1801*d*) is positioned within a portion, of the pallet (109), that spaces one or more grooves of the plurality of grooves (202) from one or more other grooves of the plurality of grooves (202).

* * * * *